US007045948B2

(12) United States Patent
Lee et al.

(10) Patent No.: US 7,045,948 B2
(45) Date of Patent: May 16, 2006

(54) FIELD EMISSION DEVICE WITH MESH GRID

(75) Inventors: Hang-woo Lee, Gyeonggi-do (KR); Jong-min Kim, Gyeonggi-do (KR); Pil-soo Ahn, Gyeonggi-do (KR)

(73) Assignee: Samsung SDI Co., Ltd., Suwon-Si (KR)

( * ) Notice: Subject to any disclaimer, the term of this patent is extended or adjusted under 35 U.S.C. 154(b) by 141 days.

(21) Appl. No.: 10/743,799

(22) Filed: Dec. 24, 2003

(65) Prior Publication Data

US 2004/0135490 A1 Jul. 15, 2004

(30) Foreign Application Priority Data

Dec. 31, 2002 (KR) ..... 10-2002-0087941

(51) Int. Cl.
*H01J 1/62* (2006.01)

(52) U.S. Cl. ..... 313/495; 313/496; 313/292

(58) Field of Classification Search ..... 313/495–497, 313/422; 315/169.1
See application file for complete search history.

(56) References Cited

U.S. PATENT DOCUMENTS 5,710,483 A 1/1998 Peng
6,373,176 B1 4/2002 Ge et al.

FOREIGN PATENT DOCUMENTS

JP 5-47354 2/1993
KR 2001-0081496 A 8/2001

OTHER PUBLICATIONS

Korean Patent Office Action and English Translation.

*Primary Examiner*—Joseph Williams
(74) *Attorney, Agent, or Firm*—Buchanan Ingersoll PC

(57) ABSTRACT

A field emission device for displaying images with good quality is provided. The field emission device includes an anode plate, an anode electrode and a phosphor layer are formed inside of the anode plate, a cathode plate, a plurality of electron emission sources for emitting electrons which correspond to the phosphor layer and a gate electrode having gate holes through which the electrons pass are formed inside of the cathode plate, a mesh grid which is provided between the cathode plate and the anode plate and in which a plurality of electron-controlling holes are formed in a region corresponding to the gate holes, a spacer which supports the mesh grid between the anode plate and the mesh grid, and insulating layers which are formed on both sides of the mesh grid and have windows through which the plurality of electron-controlling holes are exposed and which correspond to a region where the plurality of electron-controlling holes are formed.

5 Claims, 4 Drawing Sheets

FIELD EMISSION DEVICE WITH MESH GRID

BACKGROUND OF THE INVENTION

This application claims the priority of Korean Patent Application No. 2002-87941, filed on Dec. 31, 2002, in the Korean Intellectual Property Office, the disclosure of which is incorporated herein in its entirety by reference.

1. Field of the Invention

The present invention relates to a field emission device, and more particularly, to a field emission device having a grid for electron control.

2. Description of the Related Art

In general, a triode field emission device composed of a cathode electrode, a gate electrode, and an anode electrode has a structure in which electrons are extracted by one gate electrode from a cathode and are simply accelerated toward the anode electrode. Thus, some electron beams properly not being controlled in this process and emitted, and may diverge and thus be collided with a phosphor deviating from a given pixel. Due to the improperly diverged emitted electron beams, color purity is lowered. Also, a high resolution display cannot be embodied with these uncontrolled electron beams. Also, the triode field emission device has another problem in that arcing easily occurs in the triode field emission device for some well-known reasons.

The most part of these problems is solved by a separate grid electrode where electrons can be controlled, and thus, a tetrode field emission device having the grid electrode is preferred. The grid electrode in the tetrode field emission device is disposed between an anode electrode and a gate electrode.

U.S. Pat. Nos. 5,710,483 and 6,373,176 disclose a field emission device with a tetrode structure having a grid electrode for electron control.

In a field emission device disclosed in U.S. Pat. No. 5,710,483, a grid electrode is provided by a deposited metallic material formed inside of a cathode plate on which a gate electrode is formed. And a grid electrode of a field emission device disclosed in U.S. Pat. No. 6,373,176 is formed by a metallic sheet which is separated from a cathode plate, and an anode plate and the cathode plate are isolated from each other by a spacer placed therebetween.

The grid electrode formed by depositing a metallic material is limited by the size of deposition equipment. This limitation in the size of deposition equipment causes to limit the maximum size of the field emission device which can be obtained, and thus, it is not proper to manufacture a large-sized field emission device. Thus, an apparatus for deposing a metallic layer required to manufacture a large-sized field emission device must to be newly designed and manufactured, but vast costs are required. Meanwhile, the thickness of the grid electrode formed by the deposited metallic layer is limited to maximum 2 microns, and thus is not enough to effectively control electron beams.

The size of the grid electrode formed by the metallic sheet is not limited, and thus is suitable for a large-sized field emission device. In particular, the thickness of the grid electrode can be freely selected, and electron beams can be effectively controlled. However, the grid electrode formed by the metallic sheet has the disadvantage that the grid electrode may be thermally deformed during a firing process of a phosphor layer and a binder for fixing a spacer while a field emission device is manufactured.

For understanding of the thermal deformation problem, a conventional tetrode field emission device will be briefly described with the drawings.

FIG. 1A is a cross-sectional view schematically illustrating an example of a conventional field emission device adopting a grid electrode (hereinafter, referred to as a mesh grid) with a mesh structure. Referring to FIG. 1A, a cathode plate 10 and an anode plate 20 are spaced apart from each other by a spacer 30. A space between the cathode plate 10 and the anode plate 20 is vacuumized. Thus, due to an internal negative pressure, the cathode plate 10 and the anode plate 20 are securely coupled to each other in the state that the spacer 30 is placed therebetween.

On the cathode plate 10, a cathode electrode 12 is formed on a rear plate 11, and a gate insulating layer 13 is formed on the cathode electrode 12. A through hole 13*a* is formed in the gate insulating layer 13, and the cathode electrode 12 is exposed to the bottom of the through hole 13*a*. An electron emission source 14 such as carbon nanotube (CNT) is formed on the cathode electrode 12 exposed through the through hole 13*a*. A gate electrode 15 having a gate hole 15*a* corresponding to the through hole 13*a* is formed on the gate insulating layer 13.

Meanwhile, on the anode plate 20, an anode electrode 22 is formed inside of a front plate 21, a phosphor layer 23 on the anode electrode 22 is formed opposite to the gate hole 15*a*, and a black matrix 24 is formed in the other portion of the anode electrode 22.

A mesh grid 40 is interposed between the cathode plate 10 and the anode plate 20 having the above structure. The mesh grid 40 is supported by the spacer 30 in a state when the mesh grid 40 is spaced apart from the cathode plate 10 and the anode plate 20 by a predetermined gap.

The mesh grid 40 has a fixing hole 41 through which the spacer 30 passes and an electron beam-controlling hole 42 which corresponds to the gate hole 15*a*. A binder 43 is filled in the fixing hole 41 so that the mesh grid 40 is coupled to the spacer 30.

A method for coupling a spacer in a conventional field emission device having the above structure will be described as below.

First, after the phosphor layer 23 is formed on the anode electrode 22, the spacer 30 is disposed in the anode plate 20 at a predetermined interval in a state when the phosphor layer 23 has not been fired yet and then is fixed using a binder in a paste state. Next, the spacer 30, fixed in the anode plate 20, is inserted in the fixing hole 41 of the mesh grid 40 manufactured from a metallic plate, and then, the binder 43 for fixing the spacer 30 is filled in the fixing hole 41.

The mesh grid 40 and the spacer 30 are aligned, the binder 43 is cured, and then, the phosphor layer 23 is fired. The anode plate 20 and the cathode plate 10 are aligned with each other, and vacuum packaging is performed.

In the aforementioned conventional method, when a binder is cured at a temperature of about 120° C. and a phosphor layer is fired at a temperature of about 420° C., a mesh grid may be deformed by a high temperature heat and may be not well aligned with an anode plate. In particular, during vacuum packaging, secondary deformation of the mesh grid and upset of alignment of the mesh grid with the anode plate occur at a process temperature of about 300° C. or more. FIG. 1B is a photo showing a screen of the conventional field emission device, and it can be know from FIG. 1B that an image is not uniform and smeared by a deformed mesh grid.

Due to the deformation and scattering of the mesh grid and generation of the stray electros, which may cause lowering of picture quality, the performance of the field emission device is deteriorated and thus, a new method for solving these problems is required.

SUMMARY OF THE INVENTION

The present invention provides a field emission device in which the deformation of a mesh grid is effectively prevented.

According to one aspect of the present invention, there is provided a field emission device. The field emission device includes an anode plate, an anode electrode and a phosphor layer are formed inside of the anode plate, a cathode plate, a plurality of electron emission sources for emitting electrons which correspond to the phosphor layer and a gate electrode having gate holes through which the electrons pass are formed inside of the cathode plate, a mesh grid which is provided between the cathode plate and the anode plate and in which a plurality of electron-controlling holes are formed in a region corresponding to the gate holes, a spacer which supports the mesh grid between the anode plate and the mesh grid, and insulating layers which are formed on both sides of the mesh grid and have windows through which the plurality of electron-controlling holes are exposed and which correspond to a region where the plurality of electron-controlling holes are formed.

In the field emission device according to the preset invention, preferably, the mesh grid has a thickness smaller than that of each of the insulating layers, and the number of the electron-controlling holes formed inside of one window is larger than the number of the gate holes corresponding to the same window. Also, preferably, the mesh grid is spaced apart from the anode plate and the cathode plate by a predetermined gap.

BRIEF DESCRIPTION OF THE DRAWINGS

The above and other aspects and advantages of the present invention will become more apparent by describing in detail preferred embodiments thereof with reference to the attached drawings in which.

DETAILED DESCRIPTION OF THE INVENTION

Figure 1A:
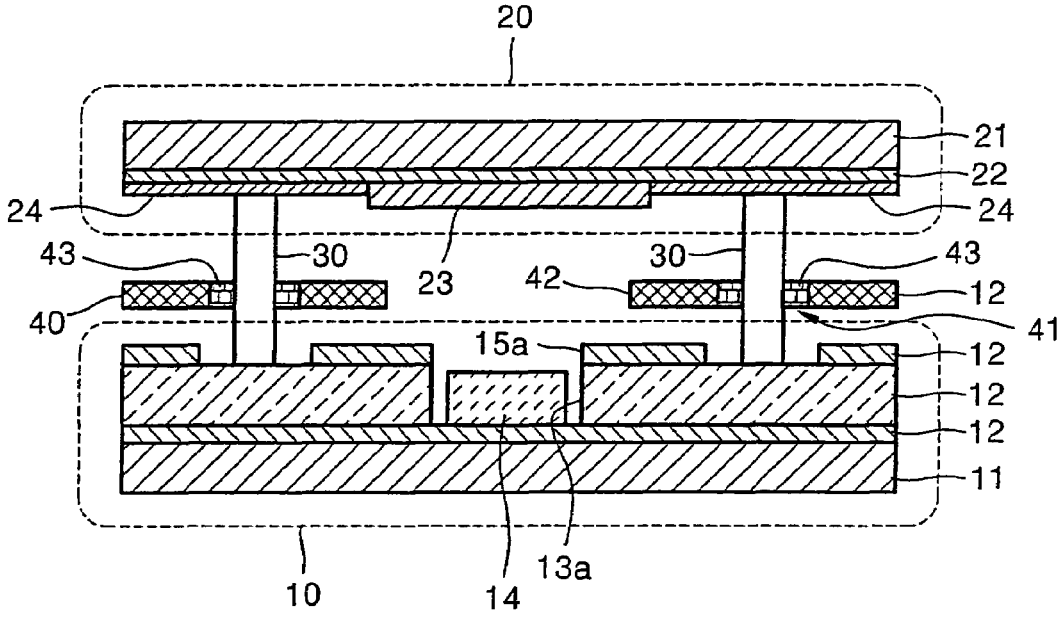
FIG. 1A PRIOR ART
FIG. 1A is a cross-sectional view schematically illustrating a conventional field emission device.
Figure 1B:
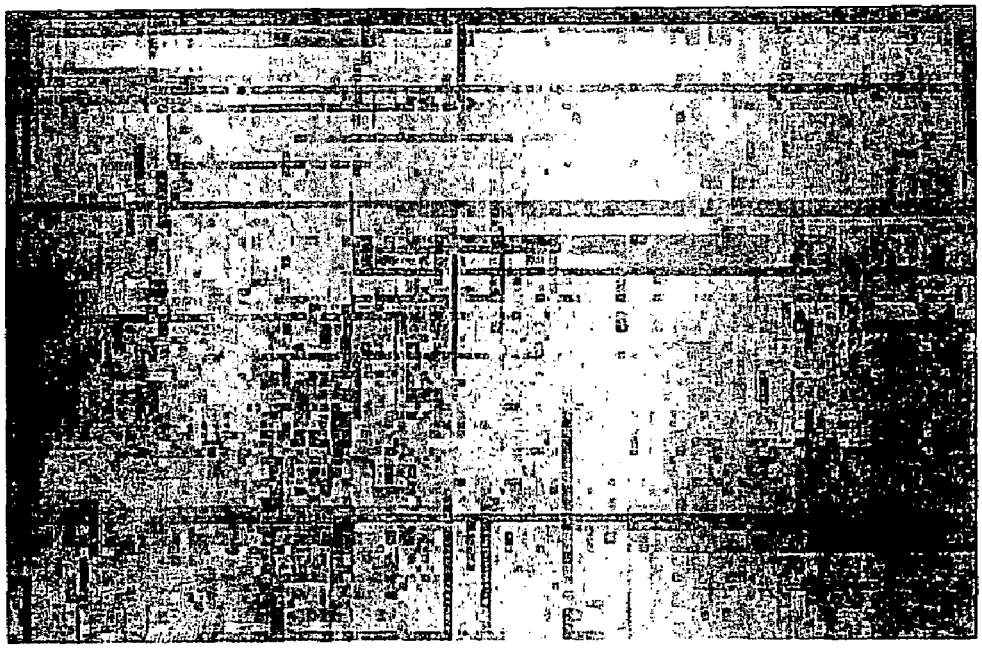
FIG. 1B PRIOR ART
FIG. 1B is a photo showing a screen of the conventional field emission device in which an image is smeared by a deformed mesh grid.
Figure 2:
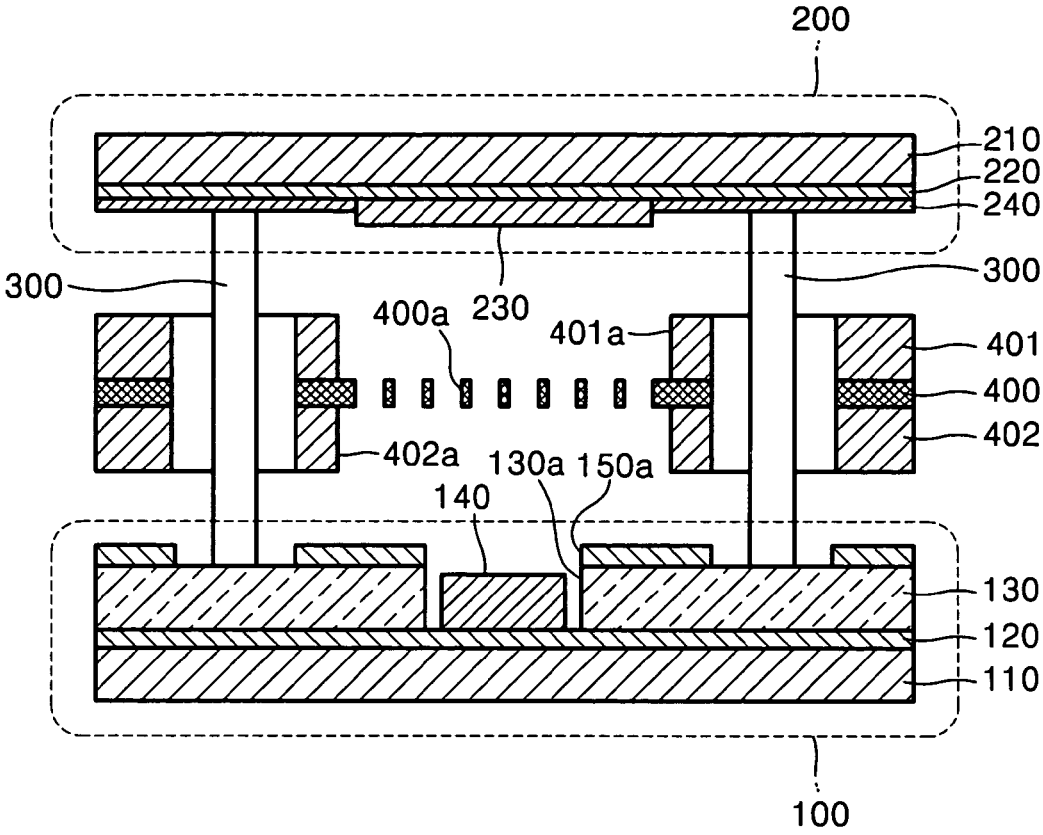
FIG. 2 is a cross-sectional view schematically illustrating a field emission device according to the present invention.

Referring to FIG. 2, a cathode 100 and an anode plate 200 are spaced apart from each other at a predetermined distance by a spacer 300. The cathode plate 100 and the anode plate 200 are vacuumized and sealed, and thus a space therebetween is vacuumized. Thus, due to an internal negative pressure, the cathode plate 100 and the anode plate 200 are securely coupled to each other in the state that the spacer 300 is placed therebetween.

On the cathode plate 100, a cathode electrode 120 is formed on a rear plate 110 which is a substrate of the cathode plate 100, and a gate insulating layer 130 is formed on the cathode electrode 120. A through hole 130*a* is formed in the gate insulating layer 130, and the cathode electrode 120 is exposed to the bottom of the through hole 130*a*. An electron emission source 140 such as carbon nanotube (CNT) is formed on the cathode electrode 120 exposed through the through hole 130*a*. A gate electrode 150 having a gate hole 150*a* corresponding to the through hole 130*a* is formed on the gate insulating layer 130.

Meanwhile, on the anode plate 200, an anode electrode 220 is formed inside of a front plate 210, a phosphor layer 230 on the anode electrode 220 is formed opposite to the gate hole 150*a*, and a black matrix 240 is formed in the other portion of the anode electrode 222 so as to perform absorption of external light and prevent optical crosstalk.

A mesh grid 400 is interposed between the cathode plate 100 and the anode plate 200 having the above structure. The mesh grid 400 is supported by the spacer 300 between the anode plate 200 and the cathode plate 100. Here, a plurality of electron-controlling holes 400*a* are arranged in the mesh grid 400. Meanwhile, insulating layers 401 and 402 are symmetrically formed on upper and lower sides of the mesh grid 400. Windows 401*a* and 402*a* having sizes that can cover the plurality of electron-controlling holes 400*a* are formed in each of the insulating layers 401*a* and 402*a*. The sizes of the windows 401*a* and 402*a* correspond to one pixel, and thus, the plurality of electron-controlling holes 400*a* correspond to one pixel.

Figure 3:
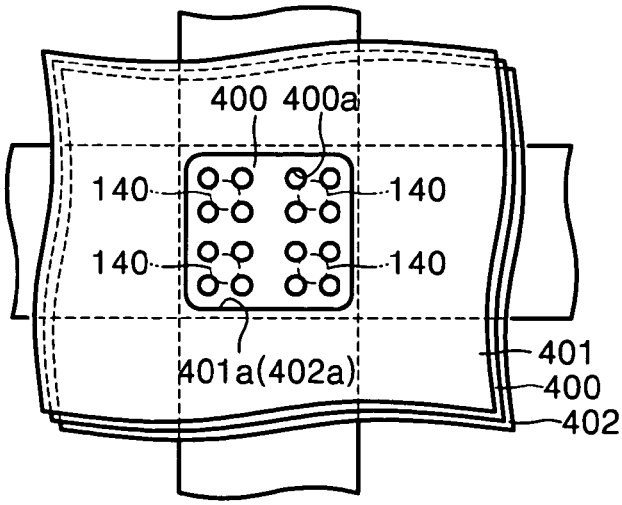
FIG. 3 is a plane view schematically illustrating the field emission device having a more substantial structure according to the present invention.

Here, in FIG. 2, one electron emission source 140 is provided to one phosphor layer 230, but a plurality of electron emission sources 140 and gate holes 150*a* corresponding to the plurality of electron emission sources 140 may be provided to one phosphor layer 230. That is, as shown in FIG. 3, the field emission device according to the present invention has a structure in which the plurality of electron emission sources 140 are substantially provided to one pixel. FIG. 2 is symbolically shown for avoiding of complexity of the drawings. Referring to FIG. 3, windows 401*a* and 402*a* symmetrical with upper and lower insulating layers are provided to one pixel, and a plurality of electron-controlling holes 400*a* (sixteen electron-controlling holes 400*a* in the present embodiment) are randomly formed in a body of the mesh grid 400 exposed to insides of the windows 401*a* and 402*a*.

The total thicknesses of the mesh grid 400 and insulating layers 401 and 402 formed on upper and lower sides of the mesh grid 400 are about 100 microns. In this case, preferably, the thickness of the mesh grid 400 is smaller than the thickness of each of the insulating layers 401 and 402. Here, preferably, the diameter of the electron-controlling hole 400*a* is about 20 microns.

Figure 4A:
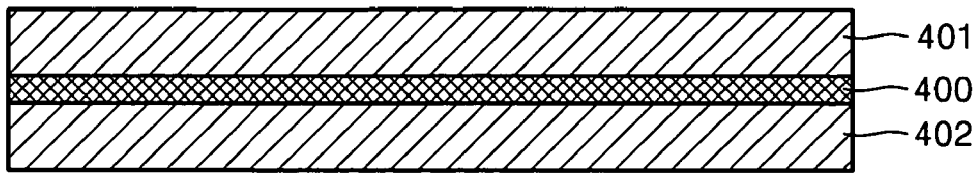
FIGS. 4A through 4C are process diagrams illustrating a method of manufacturing a mesh grid adopted in the field emission device according to the present invention.
Figure 4B:
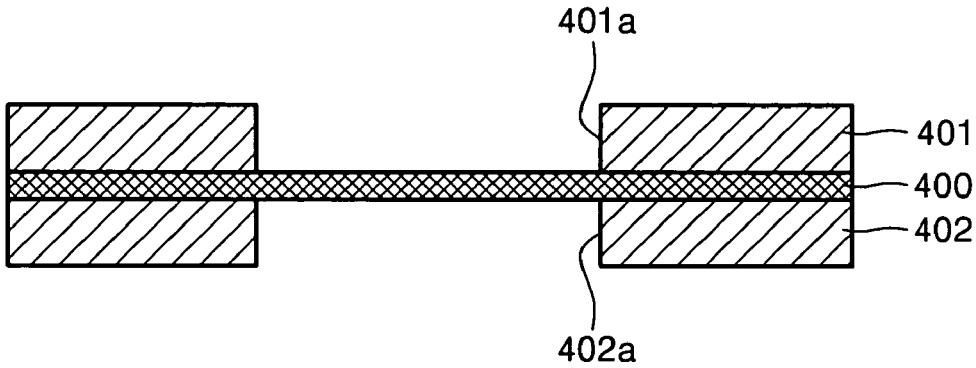
Figure 4C:
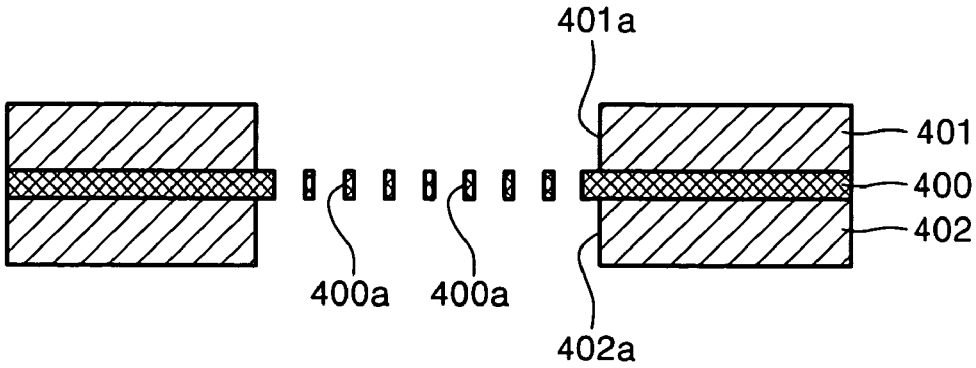

FIGS. 4A through 4C schematically illustrate a method of manufacturing the mesh grid.

As shown in FIG. 4A, insulating layers 401 and 402 are coated or laminated on upper and lower sides of a metallic plate 400.

As shown in FIG. 4B, windows 401*a* and 402*a* symmetrical with each other are formed in the insulating layers 401 and 402 by a photolithography process. As described previously, the windows 401*a* and 402*a* have sizes corresponding to one pixel in the field emission device.

As shown in FIG. 4C, a plurality of electron-controlling holes 400*a* are formed in an exposed portion of the metallic plate 400 that is not covered with the windows 401*a* and 402*a*. In this case, the size and number of each of the electron-controlling holes 400*a* are not limited by the size and position of an electron emission source and may be randomly formed.

The mesh grid 400 manufactured in the above manner is coupled to the field emission device using the same method as that of the prior art. While the mesh grid 400 is coupled to the field emission device, the upper and lower insulating layers 401 and 402 are protected from heating required for firing a binder and a phosphor layer, and in particular, the mesh grid 400 serves as a physical support against thermal deformation.

Also, an alignment margin between the mesh grid and the anode plate is increased by the randomly-formed electron-controlling holes of the mesh grid, in particular, the plurality of electron-controlling holes provided so as to have sufficient openings, such that an assembling process can be easily performed.

As described above, according to the present invention, the deformation of parts caused by firing a phosphor layer, in particular, the deformation of the mesh grid can be completely alleviated and suppressed by insulating layers formed on upper and lower sides of a mesh grid. In addition, a plurality of electron-controlling holes in a fine pattern state are provided to one pixel. Thus, as described above, even when an anode plate and the mesh grid are slightly offset, good electron control and landing can be achieved.

While this invention has been particularly shown and described with reference to preferred embodiments thereof, it will be understood by those skilled in the art that various changes in form and details may be made therein without departing from the spirit and scope thereof as defined by the appended claims.

What is claimed is:

1. A field emission device comprising:

an anode plate, an anode electrode and a phosphor layer are formed inside of the anode plate;

a cathode plate, a plurality of electron emission sources for emitting electrons which correspond to the phosphor layer and a gate electrode having gate holes through which the electrons pass are formed inside of the cathode plate;

a mesh grid which is provided between the cathode plate and the anode plate and in which a plurality of electron-controlling holes are formed in a region corresponding to the gate holes;

a spacer which supports the mesh grid between the anode plate and the mesh grid; and insulating layers which are formed on both sides of the mesh grid and have windows through which the plurality of electron-controlling holes are exposed and which correspond to a region where the plurality of electron-controlling holes are formed.

2. The field emission device of claim 1, wherein the mesh grid has a thickness smaller than that of each of the insulating layers.

3. The field emission device of claim 1, wherein the number of the electron-controlling holes formed inside of one window is larger than the number of the gate holes corresponding to the same window.

4. The field emission device of claim 2, wherein the number of the electron-controlling holes formed inside of one window is larger than the number of the gate holes corresponding to the same window.

5. The field emission device of claim 1, wherein the mesh grid is spaced apart from the anode plate and the cathode plate by a predetermined gap.

* * * * *